US008767969B1

(12) United States Patent
Laroche et al.

(10) Patent No.: US 8,767,969 B1
(45) **Date of Patent: *Jul. 1, 2014**

(54) PROCESS FOR REMOVING VOICE FROM STEREO RECORDINGS

(75) Inventors: Jean Laroche, Santa Cruz, CA (US); Tyler Brown, Thetford, VT (US); Alan Peevers, Santa Cruz, CA (US); Robert Sussman, Capitola, CA (US); Mark Dolson, Ben Lomond, CA (US)

(73) Assignee: Creative Technology Ltd, Singapore (SG)

( * ) Notice: Subject to any disclaimer, the term of this patent is extended or adjusted under 35 U.S.C. 154(b) by 1143 days.

This patent is subject to a terminal disclaimer.

(21) Appl. No.: 10/415,770

(22) PCT Filed: Sep. 27, 2000

(86) PCT No.: PCT/US00/26601

§ 371 (c)(1),
(2), (4) Date: Dec. 16, 2003

(87) PCT Pub. No.: WO01/24577

PCT Pub. Date: Apr. 5, 2001

Related U.S. Application Data

(63) Continuation-in-part of application No. 09/405,941, filed on Sep. 27, 1999, now Pat. No. 6,405,163.

(60) Provisional application No. 60/165,058, filed on Nov. 12, 1999.

(51) Int. Cl.
*H04R 5/00* (2006.01)
*H04S 3/02* (2006.01)

(52) U.S. Cl.
CPC ..... *H04S 3/02* (2013.01)
USPC ..... 381/22

(58) Field of Classification Search
CPC ..... H04S 3/02; H04S 5/005; G10L 19/008
USPC ..... 381/17–23, 71.2, 98, 119, 27, 61; 704/200, 233; 700/94
See application file for complete search history.

(56) References Cited

U.S. PATENT DOCUMENTS 4,343,969 A * 8/1982 Kellett ..... 704/254
4,461,024 A * 7/1984 Rengger et al. ..... 704/233

(Continued)

FOREIGN PATENT DOCUMENTS

JP 09-044194 * 2/1997
WO 01/24577 A1 4/2001

OTHER PUBLICATIONS

Beerends et al., "A Perceptual Audio Quality Measure Based on a Psychoacoustic Sound Representation," Journal of Audio Engineering Society, New York, vol. 40, No. 12, Dec. 1, 1992, pp. 963-978.*

(Continued)

*Primary Examiner* — Lun-See Lao
(74) *Attorney, Agent, or Firm* — Russell Swerdon; Desmund Gean

(57) ABSTRACT

A system (200) for processing a sound signal (212) that allows dynamic customization of perceived spatial positions and sound qualities of sound components associated with the sound signal (212). The system provides apparatus for processing a sound signal (212) that includes an input to receive the sound signal (212), a sound unmixer (204) coupled to the input to receive the sound signal (212) and unmix at least one sound stream (216) from the sound signal (212) based on at least one unmixing instruction (214), and an output coupled to the sound unmixer (214) to output the at least one sound stream (216).

18 Claims, 10 Drawing Sheets

(56) References Cited

U.S. PATENT DOCUMENTS

| | | | | | |
|---|---|---|---|---|---|
| 4,913,539 | A | * | 4/1990 | Lewis | 352/87 |
| 5,495,432 | A | * | 2/1996 | Ho | 708/313 |
| 5,666,424 | A | | 9/1997 | Fosgate et al. | |
| 5,727,068 | A | | 3/1998 | Karagosian et al. | |
| 5,890,125 | A | * | 3/1999 | Davis et al. | 704/501 |
| 5,943,539 | A | * | 8/1999 | Hirsch et al. | 399/266 |
| 5,946,352 | A | | 8/1999 | Rowlands et al. | |
| 5,963,907 | A | * | 10/1999 | Matsumoto | 704/270 |
| 6,021,386 | A | | 2/2000 | Davis et al. | |
| 6,111,958 | A | * | 8/2000 | Maher | 381/17 |
| 6,405,163 | B1 | * | 6/2002 | Laroche | 704/205 |
| 6,430,528 | B1 | * | 8/2002 | Jourjine et al. | 704/200 |
| 6,912,501 | B2 | * | 6/2005 | Vaudrey et al. | 704/500 |
| 6,934,395 | B2 | | 8/2005 | Ito | |
| 7,039,204 | B2 | | 5/2006 | Baumgarte | |
| 7,272,556 | B1 | | 9/2007 | Aguilar et al. | |
| 2002/0054685 | A1 | | 5/2002 | Avendano et al. | |
| 2003/0026441 | A1 | | 2/2003 | Faller | |
| 2003/0174845 | A1 | | 9/2003 | Hagiwara | |
| 2003/0233158 | A1 | | 12/2003 | Aiso et al. | |
| 2004/0196988 | A1 | | 10/2004 | Moulios et al. | |
| 2004/0212320 | A1 | | 10/2004 | Dowling et al. | |

OTHER PUBLICATIONS

International Search Report-PCT/US00/26601-Feb. 6, 2001, 1 page.

Jourjine, A., et al., "Blind separation of disjoint orthogonal signals: demixing n sources from 2 mixtures", IEEE International Conference on Acoustics, Speech, and Signal Processing, vol. 5 (2000), 2985-2988.

Lindemann, E., "Two microphone nonlinear frequency domain beamformer for hearing and noise reduction", *Applications of Signal Processing to Audio and Acoustics, IEEE ASSP Workshop on Applications of Signal Processing to Audio and Acoustics*, New Paltz NY 1995, *IEEE ASSP Workshop on Oct. 15-18, 1995*, 24-27.

Allen, et al., "Multimicrophone Signal-Processing Technique to Remove Room Reverberation From Speech Signals", J. Accoust. Soc. Am., vol. 62, No. 4, 1977, p. 912-915.

Avendano, et al., "Ambience Extraction and Synthesis From Stereo Signals for Multi-Channel Audio Up-Mix", IEEE Int'l Conf. On Acoustics, Speech & Signal Processing, May 2002.

Avendano, et al.,"Frequency Domain Techniques for Stereo to Multichannel Upmix", AES 22nd International Conference on Virtual and Entertainment Audio, Jun. 2002.

Baumgarte, et al., "Estimation of Auditory Spatial Cues for Binaural Cue Coding", IEEE Int'l Conf. On Acoustics, Speech and Signal Processing, May 2000.

Begault, et al., "3-D Sound for Virtual Reality and Multimedia" AP Professional, 226-229, 1957.

Blauert, Jens "Spatial Hearing The Psychophysics of Human Sound Localization", The MIT Press, pp. 238-257, 1997.

Dressler, Roger "Dolby Surround Pro Logic II Decoder Principles of Operation", Dolby Laboratories, Inc., 100 Potrero Ave., San Francisco, CA 94103, 2000.

Faller et al., "Binaural Cue Coding: A Novel and Efficeint Representation of Spatial Audio", IEEE Int'l Conf. On Acoustics, Speech & Signal Processing, May 2002.

Gerzon, Michael A. "Optimum Reproduction Matrices for Multispeaker Stereo" J. Audio Eng. Soc. vol. 40 No. 78, 1992.

Holman, Tomlinson, "Mixing the Sound" Surround Magazine, p. 35-37, Jun. 2001.

Jot, Jean-Marc, et al., "A Comparative Study of 3-D Audio Encoding and Rendering Techniques", AES 16th International Conference on Spatial Sound Reproduction, Rovaniemi, Finland 1999.

Kyriakakis, C., et al., "Virtual Microphones for Multichannel Audio Applications", In Proc. IEEE ICME 2000, vol. 1, pp. 11-14, Aug. 2000.

Miles, Michael T., "An Optimum Linear-Matrix Stereo Imaging System", AES 101st Convention, 1996 preprint 4364 (J-4).

Pulkki et al., "Localization of Amplitude-Panned Virtual Sources I: Sterephonic Panning", J. Audio Eng. Soc. vol. 49, No. 9, Sep. 2002.

Rumsey, Francis "Controlled Subjective Assessments of Two-to-Five Channel Surround Sound Processing Algorithms" J. Audio Eng. Soc., vol. 47, No. 7/8 Jul./Aug. 1999.

Schoeder, Manfred R., "An Artificial Stereophonic Effect Obtained From a Single Audio Signal," Journal of the Audio Engineering Society, vol. 6 pp. 74-79, Apr. 1958.

* cited by examiner

600

| | |
|---|---|
| TYPE | CENTER UNMIX |
| TIME STAMP | 10.1 |
| COMMAND | CREATEVOICE |
| VOICE ID | 1 |
| FUNCTION FLAGS | NON-INTERRUPT |
| DURATION TIME | 0.1 |
| ANGLE | 90 |
| RADIUS | 1 |
| MIX COEFFICEINT 0 | 0.25 |
| MIX COEFFICEINT 1 | 0.30 |
| MIX COEFFICIENT 2 | 0.45 |

*Fig._6*

800

801

| | | |
|---|---|---|
| TYPE | CENTER | 887 |
| TIME STAMP | 0:00 | 889 |
| COMMAND | CREATEVOICE | 885 |
| VOICE ID | 2 | 886 |
| FUNCTION FLAGS | NON-INTERRUPT | |
| DURATION TIME | 0.1 | 892 |
| ANGLE | 0 | 890 |
| RADIUS | 1 | 891 |
| MIX COEFFICIENT 0 | .33 | |
| MIX COEFFICIENT 1 | .0 | 885 |
| MIX COEFFICIENT 2 | .0 | |

802

| | | |
|---|---|---|
| TYPE | CENTER | 895 |
| TIME STAMP | 0:00 | |
| COMMAND | CREATEVOICE | 893 |
| VOICE ID | 3 | 894 |
| FUNCTION FLAGS | NON-INTERRUPT | |
| DURATION TIME | .1 | 897 |
| ANGLE | 0 | |
| RADIUS | 1 | |
| MIX COEFFICIENT 0 | .0 | |
| MIX COEFFICIENT 1 | .33 | 896 |
| MIX COEFFICIENT 2 | .0 | |

803

| | | |
|---|---|---|
| TYPE | CENTER | 874 |
| TIME STAMP | 0:00 | 878 |
| COMMAND | CREATEVOICE | 870 |
| VOICE ID | 4 | 872 |
| FUNCTION FLAGS | NON-INTERRUPT | |
| DURATION TIME | 0.1 | 884 |
| ANGLE | 0 | 880 |
| RADIUS | 1 | 882 |
| MIX COEFFICIENT 0 | .0 | |
| MIX COEFFICIENT 1 | .0 | 876 |
| MIX COEFFICIENT 2 | .33 | |

804

| | | |
|---|---|---|
| TYPE | CENTER | 814 |
| TIME STAMP | 1:00 | 818 |
| COMMAND | CREATEVOICE | 810 |
| VOICE ID | 1 | 812 |
| FUNCTION FLAGS | NON-INTERRUPT | |
| DURATION TIME | 0.1 | 824 |
| ANGLE | 90 | 820 |
| RADIUS | 1 | 822 |
| MIX COEFFICIENT 0 | .0 | |
| MIX COEFFICIENT 1 | .33 | 816 |
| MIX COEFFICIENT 2 | .0 | |

805

| | | |
|---|---|---|
| TYPE | CENTER | 830 |
| TIME STAMP | 1:30 | 834 |
| COMMAND | CREATEVOICE | 826 |
| VOICE ID | 1 | 828 |
| FUNCTION FLAGS | NON-INTERRUPT | |
| DURATION TIME | 0.1 | 840 |
| ANGLE | 180 | 836 |
| RADIUS | 1 | 838 |
| MIX COEFFICIENT 0 | .0 | |
| MIX COEFFICIENT 1 | .33 | 832 |
| MIX COEFFICIENT 2 | .0 | |

806

| | | |
|---|---|---|
| TYPE | CENTER | 846 |
| TIME STAMP | 2:00 | 850 |
| COMMAND | CREATEVOICE | 844 |
| VOICE ID | 1 | 842 |
| FUNCTION FLAGS | NON-INTERRUPT | |
| DURATION TIME | 0.1 | 856 |
| ANGLE | 225 | 852 |
| RADIUS | 1 | 854 |
| MIX COEFFICIENT 0 | .0 | |
| MIX COEFFICIENT 1 | .33 | 848 |
| MIX COEFFICIENT 2 | .0 | |

807

| | | |
|---|---|---|
| TYPE | CENTER | 862 |
| TIME STAMP | 10.1 | 866 |
| COMMAND | CREATEVOICE | 860 |
| VOICE ID | 1 | 858 |
| FUNCTION FLAGS | NON-INTERRUPT | |
| DURATION TIME | 0.1 | 872 |
| ANGLE | 270 | 868 |
| RADIUS | 1 | 870 |
| MIX COEFFICIENT 0 | .0 | |
| MIX COEFFICIENT 1 | .33 | 864 |
| MIX COEFFICIENT 2 | .0 | |

*Fig._8*

PROCESS FOR REMOVING VOICE FROM STEREO RECORDINGS

CROSS-REFERENCES TO RELATED APPLICATIONS

This application is a continuation in part of U.S. application Ser. No. 09/405,941 filed Sep. 27, 1999, now U.S. Pat. No. 6,405,163 entitled *PROCESS FOR REMOVING VOICE FROM STEREO RECORDINGS*. This application also claims priority from U.S. Provisional Patent Application 60/165,058 filed Nov. 12, 1999, entitled *DYNAMIC REPROCESSING FOR ENHANCED AUDIO AND MUSIC*, the disclosure of which is incorporated in its entirety herein for all purposes.

This application also claims the benefit of PCT Patent Application No. PCT/US00/26601, which claims priority from the above mentioned applications.

FIELD OF THE INVENTION

The present invention relates generally to a system for processing audio and music signals, and more particularly, to a dynamic processing system to produce enhanced audio and music signals.

BACKGROUND OF THE INVENTION

A consistent stream of technological developments has changed the way people listen to and enjoy audio and musical performances. For example, sound digitization has provided a way for large volumes of sound information to be stored on a small, light package known as a compact disk (CD). It is now possible for people to have home sound systems that rival even the best theater systems.

FIG. 1 shows a top view of a listening room 100 containing typical music processing equipment including a music source 102, an amplifier 104 and four speakers 106. The music source 102 is a compact disc (CD) player, but could be another type of source, like a cassette tape player. The music source 102 couples to the amplifier 104 so that music received by the amplifier 104 can be amplified and transmitted over cables 108 to the speakers 106. A listener 110 is located approximately at the center of the listening room so that the four speakers are roughly the same distance away. The speakers are designated as front left (FL), front right (FR), rear left (RL), and rear right (RR).

When music is played through the speakers it is possible for the listener 110, who is facing front, to perceive spatial positions relating to sound components within the music. For example, the listener 110 may perceive that a singer's voice 112 is directly in front of him. The listener may also perceive that the sound of a piano 114 is to his front and right, and that the sound of a guitar 116 is behind and to the left. Although FIG. 1 depicts the spatial position of musical instruments, it is also possible to perceive spatial positions for other sound generating objects. For example, spatial positions for the sound of an automobile engine or the sound of the ocean may also be perceived using the listening room 100 as show in FIG. 1.

However, a significant problem exists in that the spatial positions and sound qualities of the sound components in a recording, such as on a CD, are determined when the recording is created. Thus, it may not be possible for the sound components of a sound signal to be associated with different spatial positions or sound qualities that may be more enjoyable to the listener.

SUMMARY OF THE INVENTION

The present invention provides a system for processing a sound signal that allows listeners to dynamically customize perceived spatial positions and sound qualities of sound components associated with the sound signal. For example, the listener may configure the system to reposition the perceived position of a singer's voice or may cause the perceived position of the singer's voice to dynamically change in accordance with a preprogrammed script. The listener may also use the system to automatically reposition the perceived spatial positions of the sound components based on events detected within the sound signal itself. For example, the detected beat of a drum may be used to changed the perceived spatial position of the singer's voice. It is also possible to use the system to change the sound qualities of the sound components as desired.

One embodiment of the present invention includes apparatus for processing a a sound signal that comprises an input to receive the sound signal, a sound unmixer coupled to the input to receive the sound signal and unmix at least one sound stream from the sound signal based on at least one unmixing instruction, and an output coupled to the sound unmixer to output the at least one sound stream.

Another embodiment of the present invention provides a method of processing a sound signal. The method comprising the steps of receiving the sound signal, unmixing at least one sound stream from the sound signal based on at least one unmixing instruction, and outputting the at least one sound stream.

A further understanding of the nature and the advantages of the inventions disclosed herein may be realized by reference to the remaining portions of the specification and the attached drawings.

BRIEF DESCRIPTION OF THE DRAWINGS

FIG. 6 shows an exemplary format for a control script for use in accordance with the present invention;

FIG. 8 shows an exemplary control script that can be used to process a sound signal in accordance with the present invention;

DESCRIPTION OF THE SPECIFIC EMBODIMENTS

The present invention provides a system for processing sound signals that allows listeners to dynamically customize perceived spatial positions and/or sound qualities of components associated with the sound signals.

Figure 2:
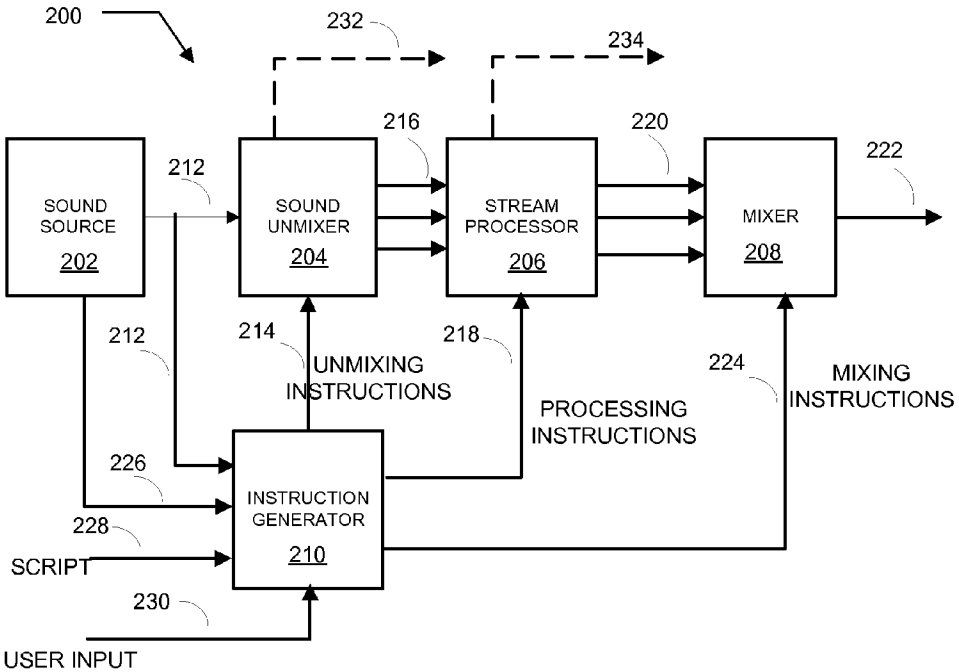
FIG. 2 shows a block diagram of a sound processing system constructed in accordance with the present invention.

FIG. 2 shows a block diagram of a sound processing system 200 constructed in accordance with the present invention. The sound processing system 200 includes a sound source 202, a sound unmixer 204, a stream processor 206, a mixer 208 and an instruction generator 210.

The sound source 202 has a sound output 212 that couples to the sound unmixer 204. In one embodiment, the sound source may be any type of sound source, such as a CD player, or cassette tape player. The sound source may also be a device that outputs sound data, such as a computer or a musical instrument like an electronic keyboard. Even a microphone picking up a live performance is suitable for use as a sound source in the present system.

The sound output 212 includes digital data representative of the sounds to be processed. If the sound source 202 is a CD, then digital data on the CD would be transmitted on the sound output 212. If the sound source is a cassette tape, wherein an analog signal represents the sounds to be processed, an analog to digital (A/D) converter could be included in the sound source to produce digital sound data for transmission on the sound output 212.

In another embodiment, the sound source 202 is a modified sound source that is capable of operating with modified media, such as modified CDs or cassette tapes that have sound data and control data stored on them. Thus, the modified sound source would be able to output both the digital sound data 212 and the control data 226 when playing back the modified media.

The sound signal can be a single signal or a combination of signals. For example, the sound source may be a CD player and the sound signal may be two signals representing the left and right channels, or four signals representing left and right channels for both front and back speaker locations.

The sound unmixer 204 is coupled to receive the sound output 212. The sound unmixer 204 also receives unmix instructions 214. The sound unmixer unmixes sound streams from the sound signal based on the unmix instructions. The unmix instructions are provided by the instruction generator 210. A later section of this document provides a complete description of the unmix instructions.

Using the unmix instructions, the sound unmixer produces one or more sound streams 216, which are also referred to as "voices." Each of the sound streams may represent various portions of the sound signal. For example, one stream may represent high frequency components of the sound signal 212, while a second stream represents low frequency components. However, the sound unmixer is very flexible in the way that it unmixes sound streams to represent portions of the input sound signal. For example, special processing may be performed on the sound signal to produce an unmixed stream that contains only certain spectral components of the sound signal. It is also possible to output unmixed sound streams directly from the sound unmixer 204 as shown at 232.

The stream processor 206 is coupled to receives the unmixed streams 216. The stream processor also receives processing instructions 218 from the instruction generator 210. The stream processor processes the unmixed streams from the sound unmixer based on the processing instructions. A later section of this document provides a complete description of the processing instructions.

Using the processing instructions, the stream processor produces processed streams 220. The stream processor 206 processes the sound streams 216 in a number of ways. For example, frequency domain processing, like pitch-shifting, may be performed. Other processes include three-dimensional (3D) position processing, wherein the perceived spatial positions of sounds represented by a stream are changed. Other types of processing performed by the stream processor 206, such as time domain processing, are described in greater detail in a later section of this document. It is also possible to output processed streams directly, as shown at 234.

The mixer 208 receives the processed streams 220 and combines them to form an output signal 222. The mixer comprises logic to combine the processed streams in accordance with mixing instructions 224 received from the instruction generator 210. The mixer may include delay lines or storage buffers to time synchronize the processed streams when forming the output signal 222. The output signal 222 may then be input to a sound system, such as the sound system of FIG. 1, to reproduce the results of the sound processing system 200 for enjoyment by the listener. Streams output directly from the sound unmixer 204 or the stream processor 206, such as streams 232 and 234, may also be input to the sound system, thereby bypassing the mixer 222.

The instruction generator 210 provides unmixing instructions 214, processing instructions 218 and mixing instructions 224. In one embodiment, the instruction generator 210 generates the instructions based on a control script received at control input 228. In another embodiment, the instruction generator generates the instructions based on information received at user input 230. In another embodiment, the instruction generator generates the instructions based on control data 226 received from the sound source 202, wherein the sound source is a modified sound source capable of outputting both sound 212 and control data 226. In another embodiment, the instruction generator generates the instructions based on information detected in the sound signal 212.

Figure 3:
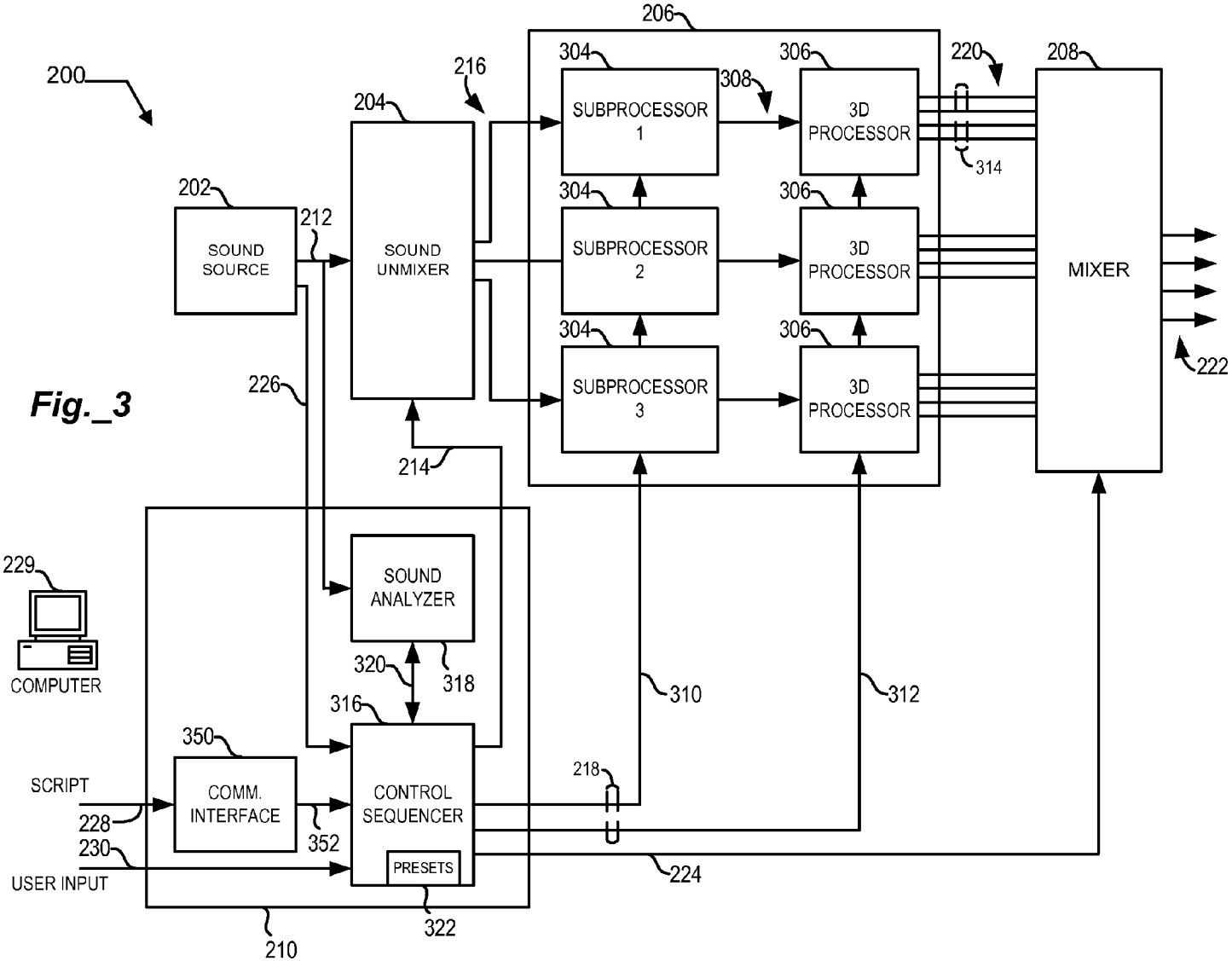
FIG. 3 shows a detailed block diagram of the sound processing system of FIG. 2.

FIG. 3 shows a detailed block diagram of the processing system 200. In the following description it will be assumed that the output produced by the processing system is suitable for use in a sound system having four speakers, such as the sound system of FIG. 1. However, it will be apparent to one with skill in the art that embodiments of the present invention can be constructed having any number of outputs to support a sound system having any number of speakers.

The processor 206 is shown comprising a number of subprocessors 304 and a corresponding number of 3D position processors 306. The subprocessors and 3D position processors are used to process the unmixed streams 216.

The subprocessors 304 are used to process the unmixed streams in ways that generally do not change their perceived spatial position. For example, a subprocessor may perform pitch-shifting or signal harmonizing on an unmixed stream. While such processes may change audible characteristics of the stream as perceived by a listener, they generally do not change the perceived spatial position, however, the subprocessors could be programmed to do so if desired. Thus, the subprocessors can perform all manner of signal processing on the unmixed streams to produce subprocessed streams 308. When the subprocessing is complete, the subprocessed streams 308 are input to the 3D position processors 306.

The 3D position processors 306 operate to reposition the perceived spatial position of the sounds in the unmixed streams. For example, assuming the listener is seated in the listening room 100 and facing front, one unmixed stream may represent the singer's voice 112. The singer's voice may be perceived to be directly in front of the listener. The 3D position processors may operate on that stream to change the perceived position of the singer's voice. For example, the singer's voice may be repositioned to be behind the listener. A more detailed example is provided in a later section of this document.

To change the perceived position of a stream, the 3D position processors produce positioning outputs 314 utilizing any 3D or 2D positioning technique. For example, in one embodiment the 3D position processors provide a portion of the unmixed stream to each speaker. By changing the portions of the sound stream provided to each speaker, the perceived spatial position of the stream may be repositioned around the listening room.

The processor instructions 218 determine what processes and positioning to perform on the streams 216. The processor instructions 218 include subprocessor instructions 310 and position processor instructions 312. The subprocessor instructions 310 are used by the subprocessors 304 to determine what signal processing functions are to be performed on the unmixed streams. For example, processes to produce pitch-shifting or echo effects. The position processor instructions 312 are used by the 3D position processors 306 to determine how to change the perceived spatial position of the subprocessed streams 308. Thus, the instruction generator 210 is capable of controlling the operation of both the subprocessors 304 and the 3D position processors 306.

The processor outputs 220 of the processor 206 are coupled to the mixer 208. Assuming that the sound processing system is designed to produce results for playback on a 4 speaker system, each of the 3D processors produces four position signals. The position signals will produce the desired spatial position for the stream when input into a four speaker sound system. It will be apparent to one with skill in the art that any number of speakers may be located in the listening room, and that based on speaker arrangements, the perceived position of unmixed streams may be changed to virtually any position.

The mixer 208 mixes together the processed signals 220 representing all the streams to produce four output signals 222 suitable for use with a four speaker sound system. The mixer 208 receives mixing instructions to determine how to mix together the streams. Thus it is possible to adjust the relative signal level of one stream with respect to another when forming the output signals 222. As a result, when played on a four speaker system, all of the streams will be perceived by a listener to have the desired processing and corresponding spatial positions.

The unmixer 204 creates and outputs the unmixed streams 216 using an unmixing process described in a later section of this document. The unmixer 204 is capable of outputting multiple unmixed streams, wherein each stream may be input to a separate subprocessor included in the processor 206.

The instruction generator 210 produces instructions for the sound unmixer 204, the subprocessors 304, the 3D processors 306 and the mixer 208. The instruction generator 210 includes a control sequencer 316, a sound analyzer 318 and a communication interface 350.

The script input 228 couples to the communication interface 350. The communication interface 350 receives the script data from an external source and provides it to the control sequencer 316 via script channel 352. The communication interface may include a modem for connecting the other computers or computer networks. The communication interface may also include additional memory for storage of received script data. Other types of communication devices may be contained in the communication interface 350. For example, infra-red (IR), radio frequency (RF) or other type of communication device may be included in the communication interface 350 so that script data may be received from a variety of sources.

The control sequencer is also coupled to receive control data 226 that may be included as part of the sound source, when the sound source is a modified sound source that outputs both sound signals and control data. For example, the control script information may be embedded on a modified CD containing both music and script data. In that case, a single CD would contain music and a control script defining how the music is to be processed to achieve a specific effect on playback.

The control sequencer also includes a memory 322 having script presets. The script presets are determined before processing begins and are stored in the memory 322 for future use.

The sound analyzer 318 is also part of the instruction generator 210. The sound analyzer 318 is coupled to the sound source 202 to receive the sound signal 212 and to detect selected events within the sound signal. For example, the beat of a drum or a crash of a cymbal may be events that are detected by the sound analyzer. The control sequencer 316 instructs the sound analyzer 318 to detect selected events via an event channel 320. The event channel 320 is also used by the sound analyzer to transmit indications to the control sequencer 316, that the selected events have been detected. The control sequencer uses these detected events to control the generation of instructions to the components of the sound processing system 200.

The user input 230 couples to the control sequencer 316 to allow a user to interact with the instruction generator 210 to control operation of the sound processing system 200. For example, the user may use the user input to select whether the external script input 228 or the control data input 226 are used to receive scripts for processing the sound signal 212. The user may also specify operation of any of the other components of the sound processing system by using the user input. In one embodiment, the user can instruct the control sequencer 316 to activate the sound analyzer 318 to detect selected events in the sound signal 212. Further, upon detection of the selected events, the control sequencer will use the presets stored in the memory 322 to generate instructions for the components of the sound processing system. The user input 230 may also be used to enter control script information directly into the instruction generator 210.

In another embodiment of the present invention, the unmixer 204 and the instruction generator 210 provide unmixed streams 216 and control instructions 214, 310, 312, 224 to an external system (not shown) that may include subprocessors, 3D position processors and mixers. The external system may be another computer program or computer system including hardware and software. The external system may also be located at a different location from the components of the system 200. As a result, it is possible to distribute the processing of the unmixed streams to one or more systems. However, it will be apparent to one with skill in the art that merely distributing the processing does not deviate from the scope of the invention, which includes ways to produce unmixed streams which may be processed in accordance with instructions based on a control script.

Therefore it is possible to process sounds in a variety of ways using the sound processing system 200. In one method, the sound is processed using events detected within the sound itself. In another method, sound is processed using script information embedded with the sound at the sound source. In another method of processing, the script information is independent from the sound source, for example, a separate data file, that can be input to the controls sequencer 316 to control how the sounds are processed.

The invention is related to the use of the sound processing system 200 for dynamic sound processing. According to one embodiment of the invention, dynamic sound processing is provided by the sound processing system 200 in response to the control sequencer 316 executing one or more sequences of one or more instructions. Such instructions may be read into the control sequencer 316 from another computer-readable medium, such as the sound source 202. Execution of the sequences of instructions causes the control sequencer to perform the process steps described herein. In alternative embodiments, hard-wired circuitry may be used in place or in combination with software instructions to implement the invention. Thus, embodiments of the invention are not limited to any specific combination of hardware circuitry and software.

The term "computer-readable medium" as used herein refers to any medium that participates in providing instructions to the control sequencer 316 for execution. Such a medium may take many forms, including, but not limited to, non-volatile media, volatile media, and transmission media. Non-volatile media include, for example, optical or magnetic disks, such as those that may be used in conjunction with the sound source 202. Volatile media include dynamic memory, such as dynamic memory that may be associated with the presets 322. Transmission media include coaxial cables, copper wire, and fiber optics, including the wires that comprise the script input 228. Transmission media can also take the form of radio or light waves, such as those generated during radio frequency (RF) and infra-red (IR) data communications. Common forms of computer-readable media include, for example, floppy disk, a flexible disk, hard disk, magnetic tape, any other magnetic medium, a CD-ROM, DVD, any other optical medium, punch cards, paper tape, any other physical medium with patterns or holes, a RAM, a PROM, and EPROM, a FLASH-EPROM, computer data storage structure, any other memory chip or cartridge, a carrier wave as describe hereinafter, or any other medium from which a computer can read.

Various forms of computer-readable media may be involved in carrying one or more sequences of one or more instructions to the control sequencer 316 for execution. For example, the instructions may initially be borne on a magnetic disk of a remote computer. The remote computer can load the instructions into its dynamic memory and send the instructions over a telephone line using a modem. A modem local to the sound processing system 200 can receive the data on the telephone line via the script input 228. The communication interface 350 receives the data and forwards the data over the channel 352 to the control sequencer 316 which executes instructions included in the data. The instructions received by the control sequencer 316 may optionally be stored in an internal memory within the control sequencer either before or after execution by the control sequencer 316.

The communication interface 350 provides a two-way data communication coupling to a script input 228 that may be connected to a local network (not shown). For example, the communication interface 350 may be an integrated services digital network (ISDN) card or a modem to provide a data communication connection to a corresponding type of telephone line. As another example, the communication interface 350 may be a local area network (LAN) card to provide a data communication connection to a compatible LAN. Wireless links may also be implemented. In any such implementation, the communication interface 350 sends and receives electrical, electromagnetic, or optical signals that carry digital data streams representing various types of information.

If the script input 228 is to be coupled to a data network, a connection may be established through a local network (not shown) to a host computer or to data equipment operated by an Internet Service Provider (ISP). The ISP in turn provides data communication services through the worldwide packet data communication network, now commonly referred to as the "Internet." The local network and the Internet both use electrical, electromagnetic or optical signals that carry digital data streams. The signal through the various networks and the signals on the script input 228 and through the communication interface 350, which carry the digital data to and from the sound processing system 200, are exemplary forms of carrier waves transporting the information.

The sound processing system 200 can send messages and receive data, including program codes, through the network(s), the script input 228 and the communication interface 350. In the Internet example, an Internet server might transmit code for an application program through the Internet, ISP, local network, and communication interface 350. In accordance with the invention, one such downloaded application provides for dynamic sound processing as described herein.

The received code may be executed by the control sequencer 316 as it is received, and/or stored in memory 322 as presets, or other non-volatile storage for later execution. In this manner, the sound processing system 200 obtains application code in the form of a carrier wave.

Figure 4:
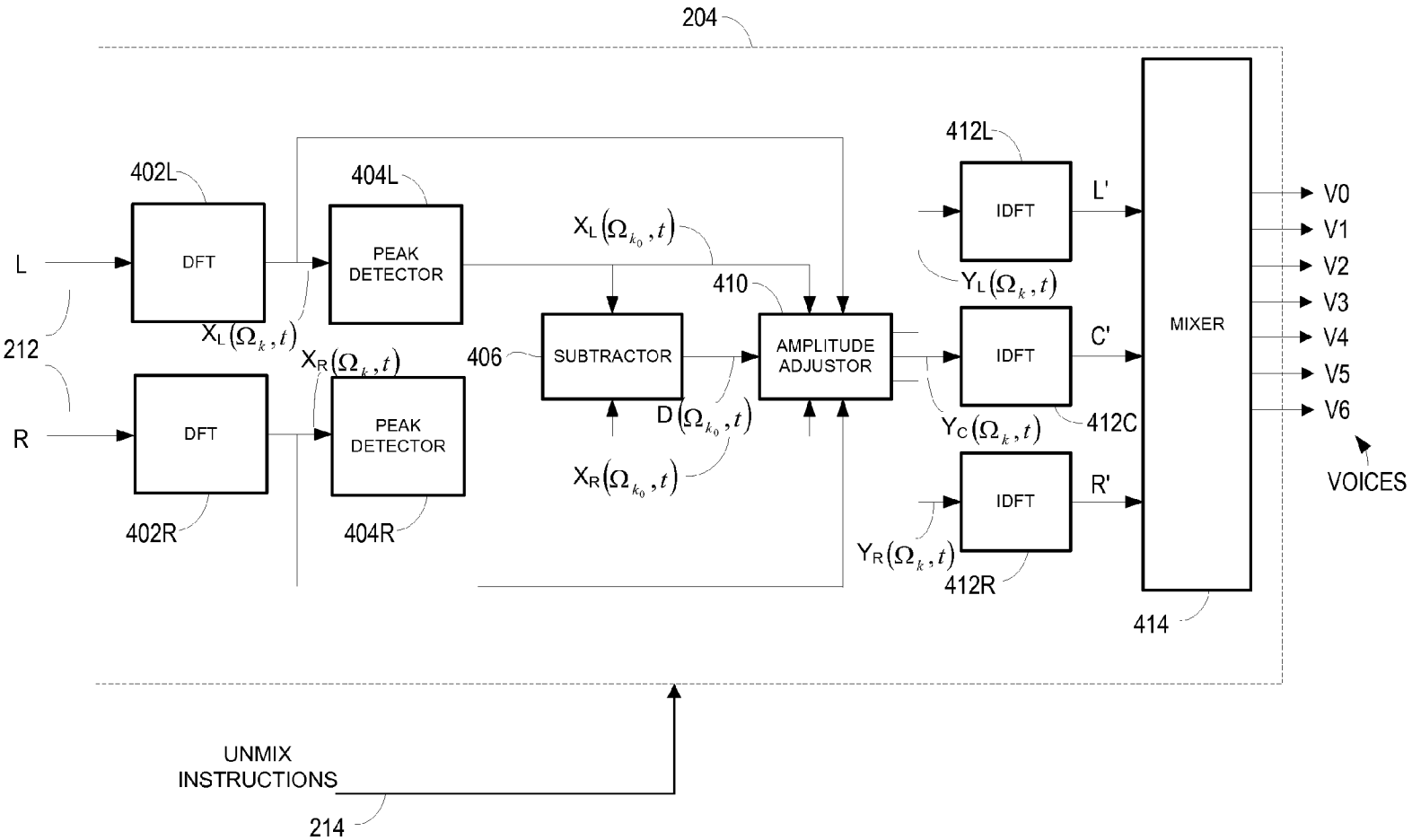
FIG. 4 is a block diagram depicting the operations of a sound unmixer included in the present invention.

FIG. 4 shows a block diagram depicting the functionality of one embodiment of the unmixer 204 including various internal operations and corresponding signals. In FIG. 4, it will be assumed that the input sound signal 212 includes left (L) and right (R) stereo channels, however it will be obvious to one skilled in the art that minor modifications can be made to process more sound channels without deviating from the scope of the invention. The left and right stereo channels are input to discrete Fourier transform (DFT) blocks 402L and 402R, respectively. In a preferred embodiment, the stereo channels will be in the form of digital signals. However, for analog stereo channels, the channels can be digitized using techniques well-known in the art.

The outputs of the DFT blocks 402L and 402R are the frequency domain spectra of the left and right stereo channels. Peak detection blocks 404L and 404R detect the peak frequencies where peaks occur in the frequency domain spectra. This information is then passed to a subtraction block 406, which generates a difference spectra signal having values equal to the difference of the left and right frequency domain spectra at each peak frequency. If voice signals are panned to center, then the magnitudes and phases of the frequency domain spectra for each channel at voice frequencies will be almost identical. Accordingly, the magnitude of the difference spectra at those frequencies will be small.

The difference signal as well as the left and right peak frequencies and frequency domain spectra are input to an amplitude adjustment block 410. The amplitude adjustment block utilizes the magnitudes of the difference spectra and frequency domain spectra of each channel to modify the magnitudes of the frequency domain spectra of each channel and output a modified spectra. The magnitude of the modified spectra depends on the magnitude of the difference spectra. Accordingly, the magnitude of the modified frequency domain spectra will be low for frequencies corresponding to voice.

The modified frequency domain spectra for each channel is input to inverse discrete Fourier (IDFT) transform blocks 412L and 412R, which output time domain signals based on the modified spectra. Since the modified spectra was attenuated at frequencies corresponding to voice the modified stereo channels (L' and R') output by the IDFT blocks 412L and 412R will have the voice removed. However, the instruments and other sounds not panned to the center will remain in the original stereo channels so that the stereo quality of the recording will be preserved. Additionally, a center output containing the unmixed spectra is input to IDFT block 412C that outputs time domain signals (C') based on the unmixed spectra.

The time domain signals L', C' and R' are input to mixer 414 that combines the received signals to produce seven "voices." Each voice represents some combination of the L', C' and R' signals. Therefore, it is possible that V0 represents only the C' signal and that V1 is comprised of some proportion of L' and C', for example.

The unmixing instructions 214 are received by the unmixer 204 and used to determine how to unmix the input signal 212 to form the output voices (VO-7). For example, the unmixing instructions specify how to combine the L', C' and R' outputs to form the voice outputs. The unmixing instructions also provide unmixing parameters that can be used by the subtracter 406 and the amplitude adjustor 410 to select a portion of input signal 212 to be unmixed and provided to the IDFT block 412C. For example, the unmixing parameters are used to select a center portion of the input signal 212 to be unmixed. Thus, equal amplitudes of frequency peaks that occur in both the left and right stereo channels would be unmixed. The effect of this operation can be demonstrated by considering a case where a singer's voice is spatially centered between the left and right channels. Since the singer's voice so positioned would result in identical frequency peaks in the left and right channels, equal amounts of these frequency peaks are removed and as a result, the singer's voice would be unmixed from the sound signal.

In another embodiment the unmixing parameters include amplitude weighting parameters that may be used to unmix signals that do not appear equally in both left and right channels. For example, the singer's voice used in the above example, may be spatially positioned off center, and thus, more toward either the left or right channel. As a result, the frequency peaks representing the singer's voice would have greater amplitude corresponding to the side where the singer voice is located. The amplitude weighting parameters are used by the subtracter 406 and the amplitude adjustor 410 to unmix the singer's voice by compensating for the greater amplitude of the frequency peaks representing the singer's voice that appear one channel (either left or right). As a result, the larger amplitude frequency peaks on that channel would be unmixed while lower amplitude frequency peaks on the other channel would be unmixed. Thus, even if the singer's voice appears to be spatially off-center, given the appropriate mixing parameters the singer's voice can still be unmixed by the unmixer 204.

The above described unmixing process can be used to unmix virtually any part of the input signal to produce one or more of the voice outputs. The unmixing is performed by hardware and/or software that receives the unmixing instructions and performs the above defined functions accordingly,. The various operations performed by the blocks of FIG. 4 will now be described in greater detail.

The Phase Vocoder and DFT

A frequency-domain representation of the input signal 212 can be obtained by use of a phase-vocoder, a process in which the incoming signal is split into overlapping, windowed, short-term frames which are then processed by a Fourier Transform, resulting in a series of short-term frequency domain spectra representing the spectral content of the input signal in each short-term frame. The frequency domain representation can then be altered and a modified time-domain signal reconstructed by use of overlapping windowed inverse Fourier transforms. The phase vocoder is a very standard and well known tool that has been used for years in many contexts (voice coding high-quality time-scaling frequency-domain effects and so on).

Assuming the incoming stereo signal is processed by the phase-vocoder, for each stereo input frame there is a pair of frequency-domain spectra that represent the spectral content of the short-term left and right signals. The short-term spectrum of the left signal is denoted by $X_L(\Omega_k,t)$, where $\Omega_k$ is the frequency channel and t is the time corresponding to the short-time frame. Similarly, the short-term spectrum of the right signal is denoted by $X_R(\Omega_k,t)$. Both $X_L(\Omega_k,t)$ and $X_R(\Omega_k,t)$ are arrays of complex numbers with amplitudes and phases.

Peak Detection

The first step consists of identifying peaks in the magnitudes of the short-term spectra. These peaks indicate sinusoidal components that can either belong to the singer's voice or to background instruments. To find the peaks, one calculates the magnitude of $X_L(\Omega_k,t)$ or of $X_R(\Omega_k,t)$ or of $X_L(\Omega_k,t)+X_R(\Omega_k,t)$ and one performs a peak detection process. One such peak detection scheme consists of declaring as peaks those channels where the amplitude of a channel is larger than the two neighbor channels on the left and the two neighbor channels on the right. Associated with each peak is a so called region of influence composed of all the frequency channels around the peak. The consecutive regions of influence are contiguous and the limit between two adjacent regions can be set to be exactly mid-way between two consecutive peaks or to be located at the channel of smallest amplitude between the two consecutive peaks.

Difference Calculation and Gain Estimation

The Left-Right difference signal in the frequency domain is obtained next by calculating the difference between the left and right spectra using:

$$D(\Omega_{k_0},t)=X_L(\Omega_{k_0},t)-X_R(\Omega_{k_0},t) \tag{1}$$

for each peak frequency $\Omega_{k_0}$.

For peaks that correspond to components belonging to the voice (or any instrument panned in the center) the magnitude of this difference will be small relative to either $X_L(\Omega_{k_0},t)$ or $X_R(\Omega_{k_0},t)$, while for peaks that correspond to components belonging to background instruments this difference will not be small. Using $D(\Omega_{k_0},t)$ to reconstruct the time-domain signal would result in the exact equivalent of the standard (Left minus Right) algorithm with a mono output.

Rather, the key idea is to calculate how much of a gain reduction it takes to bring $X_L(\Omega_{k_0},t)$ and $X_R(\Omega_{k_0},t)$ down to the level of $D(\Omega_{k_0},t)$ and apply this gain in the frequency domain, leaving the phases unchanged. Specifically the left and right gains are calculated as follows:

$$\Gamma_L(\Omega_{k_0},t)=\min(1,|D(\Omega_{k_0},t)|/|X_L(\Omega_{k_0},t)|)$$

and $$\Gamma_R(\Omega_{k_0},t)=\min(1,|D(\Omega_{k_0},t)|/|X_R(\Omega_{k_0},t)|)$$

which are the left gain and the right gain for each peak frequency. The min ( ) function assures that these gains are not allowed to become larger than 1. Peaks for which $\Gamma_L(\Omega_{k_0},t)$ is close to 0 are deemed to correspond to the voice while peaks for which $\Gamma_L(\Omega_{k_0},t)$ is close to 1 are deemed to correspond to the background instruments.

Voice Removal

To remove the voice one will apply a real gain $G_{L,R}(\Omega_{k_0},t)$ to all the channels in the region of influence of the peak:

$$Y_L(\Omega_{k_0},t)=X_L(\Omega_{k_0},t)G_L(\Omega_{k_0},t)$$

$$Y_R(\Omega_{k_0},t)=X_R(\Omega_{k_0},t)G_R(\Omega_{k_0},t).$$

The gains $G_{L,R}(\Omega_{k_0},t)$ are real, and therefore the modified channels $Y_{L,R}(\Omega_{k_0},t)$ have the same phase as the original channels $X_{L,R}(\Omega_{k_0},t)$ but their magnitudes have been modified.

To remove the voice, $G_{L,R}(\Omega_{k_0},t)$ should be small whenever $\Gamma_{L,R}(\Omega_{k_0},t)$ is small and should be close to 1 whenever $\Gamma_{L,R}(\Omega_{k_0},t)$ is close to 1.

One choice is to define $$G_{L,R}(\Omega_{k_0},t)=\Gamma_{L,R}(\Omega_{k_0},t)$$

where the modified channels $Y_{L,R}(\Omega_{k_0},t)$ are given the same magnitude as the difference $D(\Omega_{k_0},t)$. As a result, the signal reconstructed from $Y_L(\Omega_{k_0},t)$ and $Y_R(\Omega_{k_0},t)$ will retain the stereo image of the original signal but the voice components will have been significantly reduced.

Another choice is to define $$G_{L,R}(\Omega_{k_0},t)=(\Gamma_{L,R}(\Omega_{k_0},t))^{\alpha}$$

with $\alpha>0$. Where the exponent $\alpha$ controls the amount of reduction brought by the algorithm: $\alpha$ close to 0 does not remove much while large values of $\alpha$ remove more and $\alpha=1$ removes exactly the same amount as the standard Left-Right technique. Using large values $\alpha$ makes it possible to attain a larger amount of voice removal than possible with the standard technique.

In general, the gain function is a function based on the magnitude of the difference spectra.

Voice Amplification

To amplify the voice and attenuate the background instruments the gains $G_{L,R}(\Omega_{k_0},t)$ should be chosen to be close to 1 for small $\Gamma_{L,R}(\Omega_{k_0},t)$ and close to 0 for $\Gamma_{L,R}(\Omega_{k_0},t)$ close to 1, i.e., an increasing function of the inverse of the magnitude. Examples include:

$$G_{L,R}(\Omega_{k_0},t)=1-\Gamma_{L,R}(\Omega_{k_0},t) \text{ or}$$

$$G_{L,R}(\Omega_{k_0},t)=(1-\Gamma_{L,R}(\Omega_{k_0},t))/(1\neq\Gamma_{L,R}(\Omega_{k_0},t))$$

etc. Because $G_{L,R}(\Omega_{k_0},t)$ is small for channels that belong to background instruments (for which $\Gamma_{L,R}(\Omega_{k_0},t)$ is close to 1), background instruments are attenuated while the voice is left unchanged. Thus, it is possible to unmix the voice components from the sound signal.

Gain Smoothing

It is often to perform time-domain smoothing of the gain values to avoid erratic gain variations that can be perceived as a degradation of the signal quality. Any type of smoothing can be used to prevent such erratic variations. For example, one can generate a smoothed gain by setting $$\hat{G}_{L,R}(\Omega_{k_0},t)=\beta G_{L,R}(\Omega_{k_0},t)-(1-\beta)\hat{G}_{L,R}(\Omega_{k_0},t-1)$$

where $\beta$ is a smoothing parameter between 0 (a lot of smoothing) and 1 (no smoothing) and (t−1) denotes the time at the previous frame and $\hat{G}$ is the smoothed version of G. Other types of linear or non-linear smoothing can be used.

Frequency Selective Processing

Because the voice signal typically lies in a reduced frequency range (for example from 100 Hz to 4 kHz for a male voice) it is possible to set the gains $G_{L,R}(\Omega_{k_0},t)$ to arbitrary values for frequency outside that range. For example, when removing the voice we can assume that there are no voice components outside of a frequency range $\omega_{min}\rightarrow\omega_{max}$ and set the gains to 1 for frequency outside that range:

$$G_{L,R}(\Omega_{k_0},t)=1 \text{ for } \Omega_{k_0}<\omega_{min} \text{ or } \Omega_{k_0}>\omega_{max}.$$

Thus, components belonging to an instrument panned in the center (such as a bass-guitar or a kick drum) but whose spectral content do not overlap that of the voice, will not be attenuated as they would with the standard method.

For voice amplification one could set those gains to 0:

$$G_{L,R}(\Omega_{k_0},t)=0 \text{ for } \Omega_{k_0}<\Omega_{min} \text{ or } \Omega_{k_0}>\omega_{max}$$

so that instruments falling outside the voice range would be removed automatically regardless of where they are panned.

Left/Right Balance

Sometimes the voice is not panned directly in the center but might appear in both channels with a small amplitude difference. This would happen, for example, if both channels were transmitted with slightly different gains. In that case, the gain mismatch can easily be incorporated in Eq. (1):

$$D'(\Omega_{k_0},t)=\delta X_L(\Omega_{k_0},t)-X_R(\Omega_{k_0},t)$$

where $\delta$ is a gain adjustment factor that represents the gain ratio between the left and right channels. Thus, by using the appropriate delta ($\delta$) it is possible to unmix sound components that are not centered between the left and right channels, but are panned to one side or the other. The appropriate ($\delta$) will result in the frequency components of interest having a very small difference spectra.

IDFT and Signal Reconstruction

Once $Y_L(\Omega_{k_0},t)$ and $Y_R(\Omega_{k_0},t)$ have been reconstructed for every frequency channel, the resulting frequency domain representation is used to reconstruct the time-domain signal according to the standard phase-vocoder algorithm.

Figure 5:
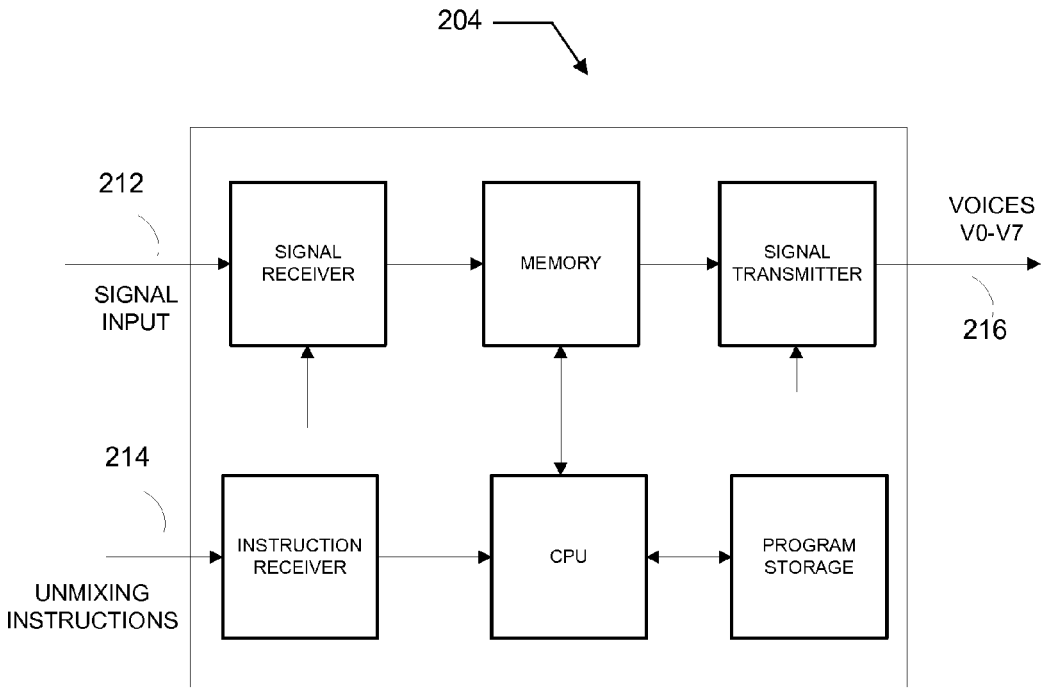
FIG. 5 is a block diagram of a computer system for implementing a sound unmixer in accordance with the present invention.

FIG. 5 is a block diagram of one embodiment of the unmixer 204 that includes a CPU, memory, input and output system, and peripherals, suitable for use to unmix selected sound components of an input signal. The unmixer 204 is capable of receiving the unmixing instructions 214 and executing unmixing software that interprets the unmixing instructions 214 to perform unmixing operations to produce the desired voices (VO-7). In a preferred embodiment, the unmixer 204 includes a digital signal processor (DSP) (not shown) under control of the CPU.

FIG. 6 shows an exemplary embodiment of sound processing instructions 600 constructed in accordance with the present invention. The sound processing instructions contain name and value pairs that can be used by the components of the sound processing system 200 to process sounds in accordance with the present invention. The following is a description of the name and value pairs of the sound processing instructions 600. However, the following list is exemplary and not intended to provide an exhaustive list of all possible processing instructions.

| INSTRUCTION | DESCRIPTION |
|---|---|
| Type | Specifies an unmixing type to be performed. |
| Time Stamp | Specifies when from the beginning of the sound signal the instruction is to be executed. |

-continued

| INSTRUCTION | DESCRIPTION |
|---|---|
| Command | Specifies the type of function to be performed. |
| Voice ID | Specifies the voice ID number to be processed. |
| Function Flags | Specifies special operations. |
| Duration Time | Specifies the time it takes to complete the command. |
| Angle | Specifies the spatial angle the voice ID will be perceived by the listener. |
| Radius | Specifies the spatial distance the voice will be perceived from the listener. |
| Mix Coeff. 0 | Specifies the mix coefficient for use with either LL or L. |
| Mix Coeff. 1 | Specifies the mix coefficient for use with either LM or C. |
| Mix Coeff. 2 | Specifies the mix coefficient for use with either LH or R. |

Figure 7:
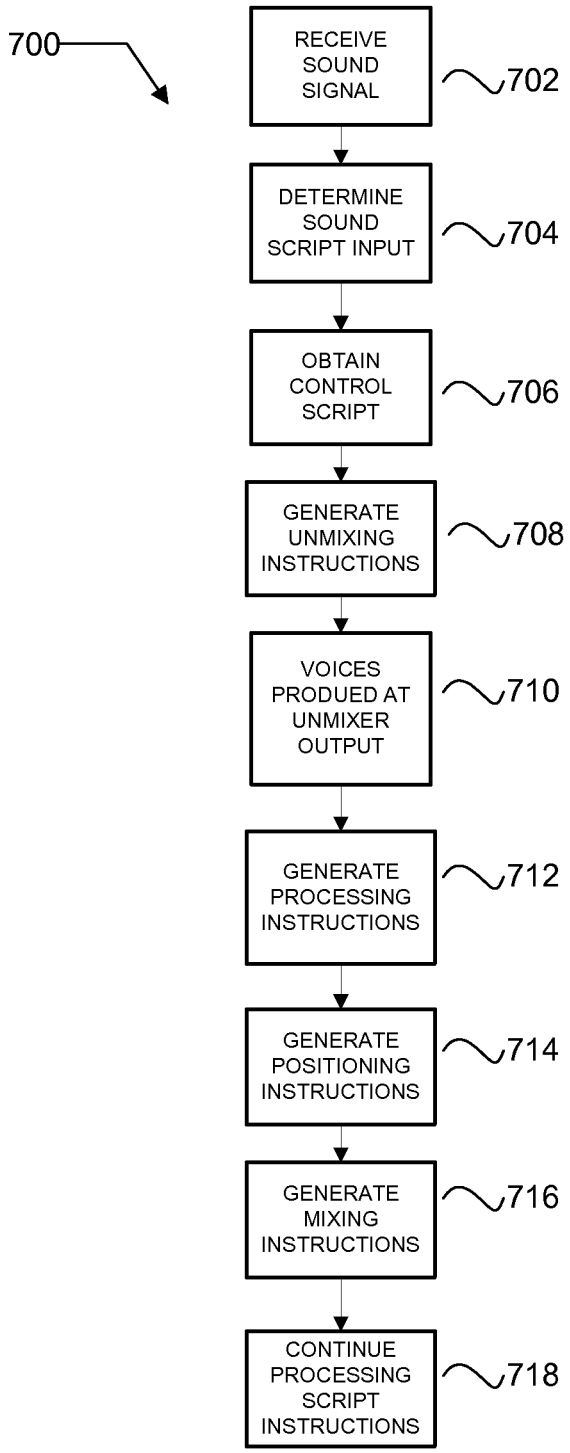
FIG. 7 shows a sound processing method for use with the sound processing system of FIG. 3.

FIG. 7 shows a sound processing method 700 for use with the sound processing system 200 of FIG. 3. The sound processing method 700 can be used to process an input sound source to reposition perceived spatial positions of sound components within the sound signal.

At block 702, a sound source provides a sound signal to the sound processing system of the present invention. For example, the sound source 202 provides the sound signal 210 for processing.

At block 704, a control script for processing the sound signal is determined. In one embodiment, the user instructs the control sequencer where to find the control script. For example, the user indicates via the user input 230 that an external script is to be received from the script input 228 or that a script accompanying the sound signal at script data input 226 is to be used.

At block 706, the control sequencer 316 begins obtaining script instructions from the selected script input.

At block 708, the control sequencer decodes the script and generates unmixing instructions to the sound unmixer 204. For example, the unmixing instructions provide coefficients for forming one or more voices 216 output from the unmixer.

At block 710, one or more voices 216 are output from the unmixer 204 in response to the unmixing instructions. Although FIG. 3 depicts three voices 216, any number of voices may be produced by the unmixer 204.

At block 712, the control sequencer 316 generates processing instructions 310 to transmit to the subprocessors 304 for processing the voices 216 created by the unmixer 204. The processing instructions instruct the subprocessors 304 to perform, for example, frequency based processing, such as pitch-shifting or signal harmonizing. The processing may also include time based processing, such as signal filtering.

At block 714, the control sequencer 316 generates positioning instructions 312 to transmit to the position processors 306 to adjust the perceived spatial positions of the subprocessed voices 308. For example, assuming the sound processing system is to be used with a four speaker system, the position processors outputs a signal for each of the four speakers to produce a perceived position of the voice to the listener. As a result, varying amounts of the voice appear in the 3D processor outputs 220.

At block 716, the control sequencer 316 generates mixing instructions to mix the processed signals 220 together. This is achieved by the mixer 208, which mixes the signals received from the processor 206, according to the mixing instructions 224, to form mixer outputs 222. The mixer outputs are transmitted to the speakers to produce sounds corresponding to the processing and spatial repositioning which can be perceived by the listener.

At block 718, the method continues by processing any remaining script instructions that exist. For example, if the sound signal is a song that lasts three minutes, the script may include a list of instructions to be processed for the three minute duration.

Time Synchronization

In order to correctly process the sound signals, time synchronization exists between the components of the processing system 200 and the sound signal. For example, if a sound signal is three minutes in duration, and spatial repositioning is to occur at two minutes into the sound signal, the instruction generator 210, the unmixer 204 and the stream processors 206 are synchronized to achieve this.

In one embodiment, the sound signal and the control scripts include time stamps. The control sequencer 316 generates instructions to the components of the processing system by reading the time stamps on the control script and sending the instructions at the appropriate time in the processing. Likewise, the subprocessors 304 and the position processors 306, read the time stamps on the instructions they receive and match those time stamps with time stamps accompanying the sound signal. Thus, it is possible to know exactly when processing is to be applied to a particular stream.

The mixer 208 also receives time stamp information with its instructions from the control sequencer 316. The mixer uses the time stamp information to determine when to apply selected mixing functions. The mixer can also obtain time stamp information from each received stream and align the received streams based on the time stamps before combining them, so that no distortion is introduce by combining misaligned streams.

In one embodiment of the present invention, a master clock is coupled to the components of the processing system 200, and is used to synchronize the components with the time stamps accompanying the sound signal and script file. In another embodiment of the present invention, a time stamp accompanying the sound signal is used to synchronize the system. In that case, each component reads the time stamp on the sound signal it is to process in order to determine when to apply the script instructions.

In another embodiment, the sound source provides an analog signal that is converted to a digital signal and tagged with a time stamp which can then be used by the components in the sound processing system 200.

Sound Processing Example

A sound processing example will now be provided to demonstrate how sounds may be processed by the sound processing system 200 using an exemplary script to achieve desired spatial effects.

FIG. 8 shows an exemplary script 800 for use in processing sounds in accordance with the present invention. The script 800 comprises seven instructions 801-807, which are to be processed to create desired spatial effects on selected sound components of sounds from a sound source.

Figure 1:
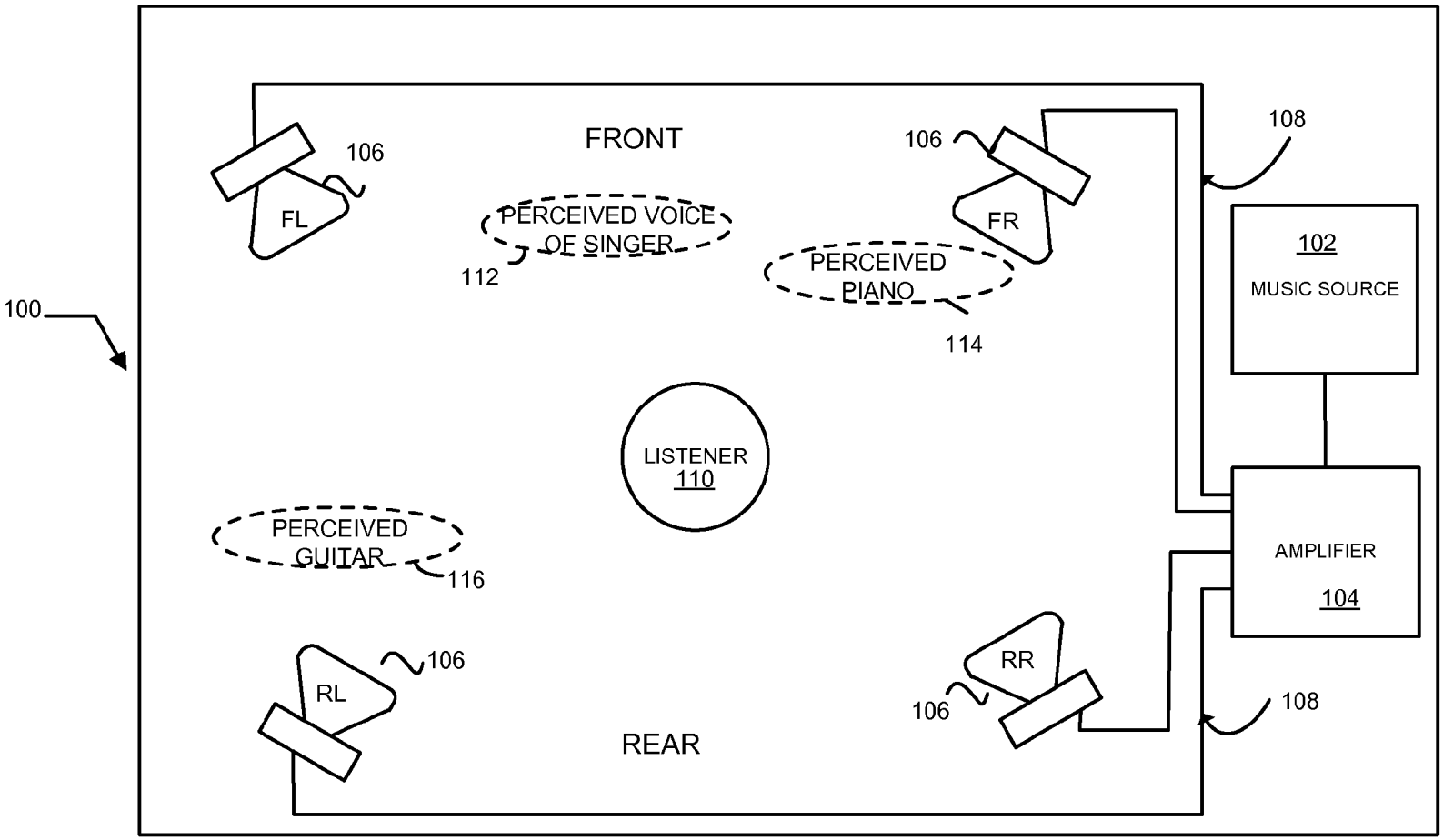
Fig. 1 (Prior Art)
FIG. 1 shows a listening room containing prior art music processing components.
Figure 9:
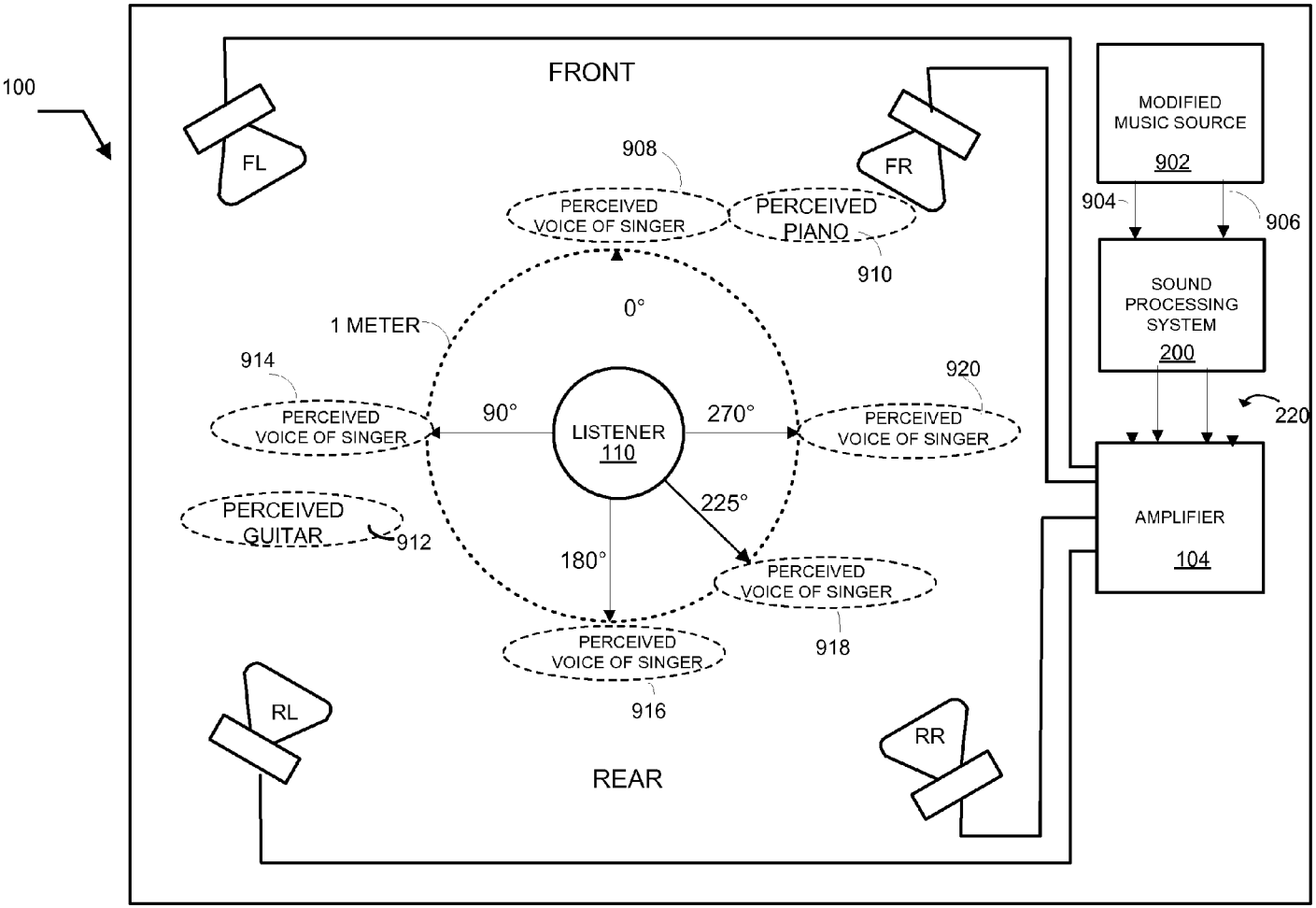
FIG. 9 shows the effects of sound processing a sound signal using the exemplary control script of FIG. 8.

FIG. 9 shows the listening room 100 of FIG. 1 and includes a modified music source 902 coupled to the sound processing system 200 of FIG. 3, which is further coupled to the amplifier 104. The modified music source 902 is modified in accordance with the present invention and has a sound output 904 and a script output 906 coupled to the sound processing system 200. For example, the modified sound source 902 may be a CD player that plays a CD having both a music track and a script file embedded on it. During playback, the music track is transmitted from the sound output 904 and the associated script file is transmitted from the script output 906. The sound processing system 200 has its four outputs 220 coupled to the amplifier 104 that provides sound signals to the four speakers in the listening room 100.

For the following discussion, it will be assumed that the music track is approximately three minutes in duration and begins at time 0:00 and ends at time 3:00. The exemplary script 800 will be assumed to be the script embedded on the CD with the music track. Thus, when the CD player is activated and playback of the CD begins, the music track and the script file are output to the sound processing system. Therefore, the music data is input to the sound unmixer and the script data is input to the instruction generator. The music track contains sounds representative of a singer's voice, a piano and a guitar. As playback begins, it is assumed that the perceived spatial positions relative to the listener 110, of the voice 908, piano 910 and guitar 912 are as shown in FIG. 9. The listener 110 is in the center of the listening room 100, facing front and equidistant from the four speakers.

Referring now to FIG. 8, the first three instructions 801, 802, and 803, which are embedded on the CD, are input to the sound processing system. Thus, the instruction generator receives the first three script instructions and generates the appropriate instruction for each component of the sound processing system 200. The first instruction 801 commands the sound processing system to execute a create voice command (885), to create voice ID 2 (886) using the center unmixing technique (887). The center unmixing technique uses coefficients 0, 1, and 2 (888), where only the coefficient 0 has a value greater than zero. The command begins at time stamp 0:00 (889) and produces a perceived voice at an angle of 0 degrees (890) at a radius 1 meter (891). The voice becomes active 0.1 seconds (892) after the time stamp 0.00. This instruction maintains the position of sound components located at the right side as provided by the original source.

The second instruction 802 commands the sound processing system to execute a create voice command (893), to create voice ID 3 (894) using the center unmixing technique (895). The center unmixing technique uses coefficients 0, 1, and 2 (896). The voice becomes active 0.1 seconds (897) after the time stamp 0.00. This instruction maintains the position of sound components located at the center as provided by the original source.

The third instruction 803 commands the sound processing system to execute a create voice command (870), to create voice ID 4 (872) using the center unmixing technique (874). The center unmixing technique uses coefficients 0, 1, and 2 (876). The command begins at time stamp 0:00 (878) and produces a perceived voice at an angle of 0 degrees (880) at a radius 1 meter (882). The voice becomes active 0.1 seconds (884) after the time stamp 0:00. This instruction maintains the position of sound components located at the left side as provided by the original source.

Therefore, at the end of the first three instructions 801, 802 and 803, the sound processing system essentially produces sound components having spatial positions corresponding to the spatial positions initially provided by the sound source.

Referring now to FIG. 9, the voices having IDs (2, 3 and 4) created by the instructions 801, 802 and 803, in the singer's voice 908, the guitar 912 and the piano 910. Center unmixing was used for each instruction and the three relevant coefficients are set so that portions of the Left, Right and Center of the original sound source are used to create the voices having IDs of 2, 3 and 4. These instructions generally maintain the perceived position of the sound components as provided by the sound source.

Referring now to FIG. 8, the fourth instruction 804, embedded on the CD, is input to the sound processing system. The fourth instruction commands the sound processing system to execute a create voice command (810), to create voice ID 1 (812) using the center unmixing technique (814). The center unmixing technique uses coefficients 0, 1, and 2 (816). The command begins at time stamp 1:00 (818) and produces a perceived center voice at an angle of 90 degrees (820) at a radius 1 meter (822). The voice becomes active 0.1 seconds (824) after the time stamp 1:00.

Referring now to FIG. 9, the voice created by the instruction 804 includes the center portion of the sound which generally includes the singer's voice. Since center unmixing as used, the coefficients 816 are set so that only the coefficient for the center band has a non-zero value. As a result, the sounds in the center portion, which include the singer's voice, are rotated from an initial spatial position at 908 to the position shown at 914. Two copies of the singer's voice can now be perceived by the listener. The first copy is derived from voice ID 3 and is perceived at position 908. The second copy is derived from voice ID 1 and is perceived 1 meter from the listener at an angle of 90 degrees as shown at 914.

Referring again to FIG. 8, the fifth instruction (805) modifies the voice created having voice ID 1 (828), by executing another create voice command (826). The fifth instruction commands the music processing system to execute the create voice command again using the center unmixing technique (830). The center unmixing technique uses coefficients 0,1 and 2 (832). The command begins at time stamp 1:30 (834) and produces a perceived voice at an angle of 180 (836) and a radius 1 meter (838). The voice becomes active 0.1 seconds (840) after the time stamp 1:30.

Referring now to FIG. 9, the voice created by the instruction 805 is shown. Notice the effect of the instruction was to rotate the perceived voice from the position 914 to a new position shown at 916. The perceived positions of the piano 908 and the guitar 910 are not changed by the execution of the instruction 805, since they are not part of the stream unmixed using the center unmixing technique. Thus, two copies of the singer's voice are perceived, one at position 908 due to voice ID 3, and one at position 916 due to voice ID 1.

Referring again to FIG. 8, the sixth instruction (806) again modifies the voice created having voice ID 1 (842), by executing another create voice command (844). The sixth instruction commands the music processing system to execute the create voice command again using the center unmixing technique (846). The center unmixing technique uses coefficients 0,1 and 2 (848). The command begins at time stamp 2:00 (850) and produces a perceived voice at an angle of 225 degrees (852) and a radius 1 meter (854). The voice becomes active 0.1 seconds (856) after the time stamp 1:30.

Referring now to FIG. 9, the voice created by the instruction 806 is shown. Notice the effect of the instruction was to again rotate the perceived voice from the position 916 to a new position shown at 918. Thus, two copies of the singer's voice are perceived, one at position 908 due to voice ID 3, and one at position 918 due to voice ID 1.

Referring again to FIG. 8, the seventh instruction (807) again modifies the voice created having voice ID 1 (858), by executing another create voice command (860). The seventh instruction commands the music processing system to execute the create voice command again using the center unmixing technique (862). The center unmixing technique using coefficients 0,1 and 2 (864). The command begins at time stamp 2:30 (866) and produces a perceived voice at an angle of 270 degrees (868) and a radius 1 meter (870). The voice becomes active 0.1 seconds (872) after the time stamp 2:30.

Referring now to FIG. 9, the voice created by the instruction 807 is shown. Notice that the effect of the instruction is to again rotate the perceived voice from the position 918 to a new position shown at 920. Thus, two copies of the singer's voice are perceived, one at position 908 due to voice ID 3, and one at position 920 due to voice ID 1.

Therefore, the above example demonstrates that by providing script instructions to the sound processing system 200 included in the present invention, the perceived spatial position of sounds can be manipulated in a variety of ways given a particular speaker arrangement.

Figure 10:
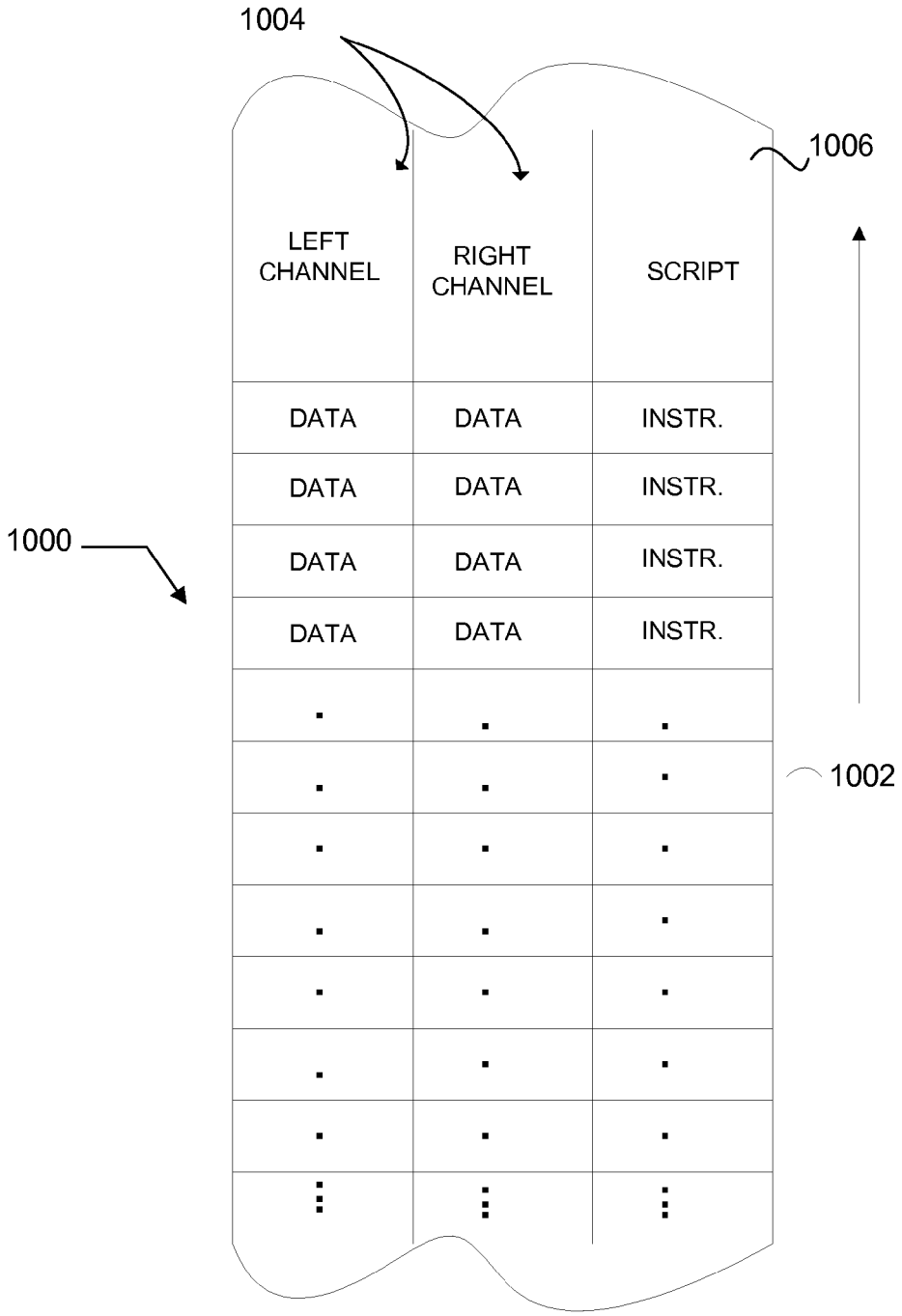
FIG. 10 show an exemplary portion of a storage medium 1000 that includes a data track with embedded sound data and script data.

FIG. 10 shows an exemplary portion of a storage medium 1000 that has a data track 1002 with embedded sound 1004 and script data 1006 and can be used in accordance with the present invention. The storage medium 1000 could be part of a CD, tape, disk or other type of storage medium used to store sound signals.

The present invention provides a method and apparatus for processing sound signals to produced enhanced sound signals. It will be apparent to those with skill in the art that modifications to the above methods and embodiments can occur without deviating from the scope of the present invention. Accordingly, the disclosure and descriptions herein are intended to be illustrative, but not limiting, of the scope of the invention which is set forth in the following claims.

What is claimed is:

1. A method for analyzing an audio signal including first and second channel signals, the method comprising:

forming a frequency-domain representation of the audio signal, the representation having a plurality of frequency indices including a first frequency index;

computing, from said frequency-domain representation, a difference between the first channel and the second channel spectra, using a subtraction function, at each of the plurality of frequency indices to generate an inter-channel similarity measure for each of the plurality of frequency indices;

deriving, from the inter-channel similarity measure, a signal scaling factor for each of the plurality of frequency indices; and applying said signal scaling factor, using an amplitude adjustor, to said frequency-domain representation at each of the plurality of frequency indices in order to emphasize or attenuate signal components characterized by a high similarity measure to change the perceived spatial position of the signal components.

2. The method as recited in claim 1 wherein the signal scaling factor applied is a function of the magnitude of the inter-channel similarity measure.

3. The method as recited in claim 1 wherein the signal scaling factor is selected to be inversely proportional to the value of the inter-channel similarity measure.

4. The method as recited in claim 1 wherein, the signal scaling factor is applied to frequency domain signals at frequency indices wherein the difference falls below a predetermined threshold, and wherein the signal scaling factor attenuates the frequency domain signals at those frequency indices.

5. The method as recited in claim 1 wherein the signal scaling factor for each of the plurality of frequency indices is selected so that in a first selected frequency band scaling is applied and for frequencies outside that band no scaling is provided.

6. The method as recited in claim 1 further comprising converting the scaled signals back to the time domain.

7. An apparatus configured for processing an audio signal having first and second channel signals, the apparatus comprising:

a processing section for generating at least a frequency domain representation of the audio signal, the frequency domain representation having a plurality of frequency indices;

an arithmetic processing module configured to compute, from the frequency domain representation, a difference between the first channel and the second channel spectra, using a subtraction function, at each of the plurality of frequency indices to generate an inter-channel similarity measure for each of the plurality of the frequency indices corresponding to the frequency domain representation of the audio signal, an amplitude adjusting portion configured to derive, from the inter-channel similarity measure, a signal scaling factor for each of the plurality of frequency indices; and apply said signal scaling factor, using an amplitude adjustor, to said frequency-domain representation at each of the plurality of frequency indices in order to emphasize or attenuate signal components characterized by a high similarity measure to change the perceived spatial position of the signal components.

8. The apparatus as recited in claim 7 wherein each channel is represented by a time-frequency representation including a time index and a frequency index, the audio signal further comprising a time- and frequency-based set of parameters that can be applied to the audio signal to extract at least two sound streams, each sound stream being a component of the audio signal and at least one of the sound streams representing a sound source within the audio signal, the sound streams including at least one vocal stream and at least one non-vocal stream, wherein the time- and frequency-based set of parameters for the sound streams allow each sound stream to be separately generated.

9. The apparatus as recited in claim 8 further comprising:

a stream synthesizer to receive the audio signal and to receive the time- and frequency-based set of parameters, and to apply the time- and frequency-based set of parameters to the sound signal on the two or more channels to separately extract the sound streams.

10. The apparatus as recited in claim 9 further comprising a stream processor configured to receive the extracted sound streams and to receive a processing instruction with which to process a sound stream, and wherein the stream processor is configurable to reposition one of the vocal streams relative to the position of an original vocal stream in the sound signal.

11. The apparatus of claim 8 wherein the at least two sound streams are defined such that additively combining them results in a signal substantially equivalent to the original sound signal.

12. The apparatus of claim 8 wherein the time-frequency representation is a short-time Fourier transform.

13. The apparatus of claim 8 wherein the set of parameters for a sound stream includes a weighting factor to indicate the degree to which the contents of the time-frequency representation for the time index and the frequency index should be attributed to said sound stream.

14. The apparatus of claim 8 wherein a characteristic that is unique to one of the sound streams is that it is equally-weighted between two of the channels.

15. The apparatus of claim 8 wherein additively combining the at least two sound streams results in a signal substantially equivalent to the original sound signal.

16. The apparatus of claim 10 further comprising:

a mixer module to receive processed streams from the stream processor and to mix them into an output suitable for a loudspeaker configuration.

17. The apparatus of claim 8 further comprising a user input module to generate processing instructions based on user-specified preferences.

18. The apparatus of claim 8 further comprising a stream processor configured to receive the extracted sound streams and to receive a processing instruction with which to process a sound stream, and wherein the stream processor is configured to specify pitch-shifting of at least one of the sound streams.

* * * * *